US011053044B2

(12) United States Patent
Mills

(10) Patent No.: US 11,053,044 B2
(45) Date of Patent: Jul. 6, 2021

(54) LABELLING APPARATUS

(71) Applicant: MAREL LTD, Colchester (GB)

(72) Inventor: Sean James Mills, Harwich (GB)

(73) Assignee: MAREL LTD, Colchester (GB)

( * ) Notice: Subject to any disclaimer, the term of this patent is extended or adjusted under 35 U.S.C. 154(b) by 0 days.

(21) Appl. No.: 16/312,673

(22) PCT Filed: Jun. 29, 2017

(86) PCT No.: PCT/EP2017/066167
§ 371 (c)(1),
(2) Date: Dec. 21, 2018

(87) PCT Pub. No.: WO2018/002242
PCT Pub. Date: Jan. 4, 2018

(65) Prior Publication Data

US 2019/0256237 A1 Aug. 22, 2019

(30) Foreign Application Priority Data

Jun. 29, 2016 (EP) ..... 16176962

(51) Int. Cl.
*B65C 1/02* (2006.01)
*B65C 9/02* (2006.01)
(Continued)

(52) U.S. Cl.
CPC ..... *B65C 1/026* (2013.01); *B65C 1/042* (2013.01); *B65C 9/02* (2013.01); *B65C 9/1803* (2013.01); *B65C 9/30* (2013.01); *B65C 9/44* (2013.01)

(58) Field of Classification Search
CPC ..... B65C 1/026; B65C 1/04; B65C 1/042; B65C 9/02; B65C 9/1803; B65C 9/30; B65C 9/40; B65C 9/44; B65B 13/182
See application file for complete search history.

(56) References Cited

U.S. PATENT DOCUMENTS 6,598,647 B1 7/2003 Draghetti
2015/0007936 A1* 1/2015 Bernhard ..... B65C 1/042 156/277

FOREIGN PATENT DOCUMENTS

CN 204642346 U 9/2015
EP 1118542 A1 7/2001
(Continued)

OTHER PUBLICATIONS

European Search Report from EP Application No. 16176962, dated Dec. 23, 2016.
(Continued)

*Primary Examiner* — George R Koch
(74) *Attorney, Agent, or Firm* — Workman Nydegger

(57) ABSTRACT

A labelling apparatus for labelling a tray while the tray is conveyed by a conveyor means. A label feeder device is configured to place a label onto a top surface of the tray. A first tucker device is arranged sidewise to the conveyor means and includes an applicator block. A first moving mechanism is configured to move the applicator block in a back and forth direction perpendicular to the conveying direction of the tray. The applicator block is movable from an initial position to a labelling position where the applicator block presses the portion of the label exceeding a side surface of the tray such that the applicator block follows the shape of the side surface of the tray via a rotational movement of the applicator block around the rotation axis.

15 Claims, 4 Drawing Sheets

(51) Int. Cl.

| | |
|---|---|
| ***B65C 9/18*** | (2006.01) |
| ***B65C 9/30*** | (2006.01) |
| ***B65C 9/44*** | (2006.01) |
| ***B65C 1/04*** | (2006.01) |

(56) References Cited

FOREIGN PATENT DOCUMENTS

| | | | |
|---|---|---|---|
| EP | 2695819 | A1 | 2/2014 |
| EP | 2695819 | B1 | 8/2014 |
| GB | 403880 | A | 1/1934 |
| RU | 2212368 | C2 | 9/2003 |
| WO | 9928195 | A1 | 6/1999 |
| WO | 2014179829 | A1 | 11/2014 |
| WO | 2015140570 | A1 | 9/2015 |

OTHER PUBLICATIONS

International Search Report from PCT Application No. PCT/EP2017/066167, dated Sep. 25, 2017.
Search report from corresponding Russian Application No. 2019101643, dated Sep. 1, 2020.

* cited by examiner

LABELLING APPARATUS

The application is a 371 of PCT/EP2017/066167, filing date Jun. 29, 2017.

FIELD OF THE INVENTION

The present invention relates to a labelling apparatus for labelling a tray while the tray is conveyed by a conveyor means.

BACKGROUND OF THE INVENTION

Labelling devices that are capable of automatically labelling food items or packages have existed for the last decades.

EP1118542 discloses a method for labelling products that are sold with a sleeve-type product identification band or wrapping member which serves to encircle or wrap around a tray, such as the one shown in FIG. 1. FIG. 1*a* depicts graphically a perspective view of an example of a tray 101 used for storing food items, where the sides of the tray have wing-shaped surface. FIG. 1*b* shows an enlarged view of the tray in FIG. 1*a* after being labelled by a prior art labelling apparatus with an oblong label 102 wrapped around the tray along the wing-shaped sides of the tray. This type of labelling is often referred to as D-wrapped labelling. The empty space 103 that is formed often causes that the label 102 becomes torn apart when e.g. a customer picks up the item, or during the transport of the tray. This obviously makes the appearance of the item less attractive.

GB403,880 discloses a banding device for banding a box, where the device comprises a pair of rollers and a member. A strip is supplied by a pincer into a position adjacent to a top surface of the box. The pair of rollers and the member are positioned above the box. The strip is initially fixed to the top of the box by supplying a pressure by the member onto the top surface of the box. The pair of rollers are subsequently moved along the sides of the box forcing the strip towards the sides of the box, followed by turning the strip around the edges of the box. This banding device is however limited to banding boxes, i.e. items having a simple geometrical shape. Also, the downward movement of the pair of rollers from above results in that it is impossible to label light weight trays having a complicated geometrical shape and to ensure that the label follows complicated side surfaces, e.g. trays having a wing-shaped side surface. At best, the result would be a labelling having empty spaces as shown in FIG. 1*b*.

SUMMARY OF THE INVENTION

On the above background it is an object of the present invention to provide a labelling apparatus that is capable of automatically labelling trays with a label, e.g. any type of an oblong label, sleeve type label, and the like, in a way that the risk of accidentally torn the label apart is eliminated.

Embodiments of the invention preferably seeks to mitigate, alleviate or eliminate one or more of the above mentioned disadvantages of the prior art singly or in any combination. In particular, it may be seen as an item of embodiments of the present invention to provide a labelling apparatus that solves the above mentioned problems, or other problems.

To better address one or more of these concerns, in a first aspect of the invention a labelling apparatus is provided for labelling a tray while the tray is conveyed by a conveyor means, comprising:

a label feeder device configured to place a label onto a top surface of the tray such that the label extends across the tray with a portion of the label exceeding at least one side surface of the tray, a first tucker device arranged sidewise to the conveyor means, comprising:

- at least one applicator block rotatable mounted to an axis extending parallel to the conveying direction and the at least one side surface of the tray,
- a first moving mechanism configured to move the at least one applicator block in a preferably horizontal back and forth direction perpendicular to the conveying direction of the tray, wherein during labelling the first moving mechanism, in response to a control signal, moves the at least one applicator block from an initial position to a labelling position where the at least one applicator block presses the portion of the label exceeding the at least one side surface of the tray towards the at least one side surface of the tray such that the at least one applicator block follows the shape of the at least one side surface of the tray via a rotational movement of the at least one applicator block around the rotation axis.

Accordingly, due to the rotational movement of the at least one applicator block it is ensured that the portion of the label exceeding at least one side surface of the tray follows the shape of the surface side and thus prevents formation of empty spaces that otherwise may risk tearing the label.

The tray may include any kind of a tray e.g. used within the food industry for storing any type of food products, where the sides of the tray has a wing-shaped surface with a top portion of the opposite sides of the tray extending outwardly from the opposite sides in opposite direction forming a lip, but this portion is typically for facilitating the sealing of upper surface of the tray with a plastic film or similar means. For such instances, the at least one applicator block may initially press the portion of the label exceeding at least one side surface of the tray under this top portion so as to ensure that there will be no empty space below this portion, where subsequently via the rotational movement of the at least one applicator it is ensured that the remaining part of the label portion follows the shape of the side of the label, and a subsequent folding of the label under the tray if needed.

Moreover, the ability to wrap the label on the tray while the tray is continually moving give rise to a high production throughput.

The labels may have all types of shape and may as an example be oblong labels that are adapted to be mounted to the items in a sleeve or sleeve-simulating format which serves to encircle or wrap at least partly around the items. The tray preferably has a substantially flat surface (sealing film and the like), and where the labels may be adapted to fully encircle the tray (often referred to as D-wrap), or e.g. to encircle only the top and bottom and one side of the items in the trays (often referred to as C-wrap).

The present invention is not limited to any particular shape of labels, e.g. should not be construed to be limited to the above mentioned shape, but any type of shapes is possible.

It should be noted that the term "pressing" should not be construed as pressing with high force against the at least one side of the tray such that the tray gets damaged. The above mentioned first tucker device is of course positioned such that a minimal pressure is applied onto the label against the at least one side of the tray needed to get an adhesion between the label and the tray.

In one embodiment, the at least one applicator block comprises two opposingly arranged applicator blocks positioned at opposite sides of the conveyor means, and where the movement of the at least one applicator block in a back and forth direction comprises:

moving the two opposingly arranged applicator blocks towards each other where the applicator blocks simultaneously press the portion of the label exceeding both the side surfaces of the tray to the opposite surface sides of the tray, and moving the two applicator blocks away from the opposite side surface sides of the tray.

Accordingly, the labeling is performed at both opposite sides of the tray where also the two opposingly arranged applicator blocks ensure that the tray will not move during the labelling process.

In one embodiment, the apparatus further comprises at least one folding plough arranged upstream in relation to the first tucker device configured to interact with the portion of the label exceeding at least one side surface of the tray so as to folding it down with the at least one side surface. It is thus ensured that the portion of the label exceeding the at least one side surface of the tray is sufficiently folded down before the labelling is initiated. In case of said two opposingly arranged applicator blocks there will of course be folding plough associated with each of them, at opposite sides of the tray.

In one embodiment, the apparatus further comprises a second tucker device arranged above the first tucker device, the second tack device comprising:

at least one structure having a free-end following the shape of the at least one side surface of the tray, the at least one structure being positioned adjacent and above the first tucker device, a second moving mechanism configured to move the structure in a preferably horizontal back and forth direction perpendicular to the conveying direction of the tray, wherein during labelling the second moving mechanism, in response to the control signal, is configured to initially move the at least one structure to a labelling position where the free-end of the at least one structure presses the portion of the label exceeding at least one side surface of the tray towards an upper side portion of the at least one side surface of the tray, followed by said movement by the first moving mechanism. This is of particular advantage when the tray has at the upper portion of the at least one side areas that is difficult to access by the at least one applicator block. This may as an example be the case where, as already mentioned, the sides of the tray have a wing-shaped surface with a top portion of the opposite sides of the tray, i.e. the lips, extending outwardly from the opposite sides in opposite direction. Accordingly, the free-end of the structure ensures that the label portion at the upmost part of the sides will get attached upmost corner of the at least one sides and thus, despite such a challenging surface sides, it is ensured that there will be no empty space between the label and the tray.

In one embodiment, the at least one applicator block has a triangular cross sectional shape, the first tucker device further comprising an upwardly extending block having an upper flat surface, said initial position being an initial angular position where one side of the at least one triangular shaped applicator block is adjacent and parallel to the upper flat surface, the upper flat surface being configured to interact with the at least one triangular shaped applicator block subsequent to said labelling and bring it back to said initial angular position. In that way it is ensured that the application block is always in the same initial position.

The second moving mechanism comprises in one embodiment a linearly displaceable piston where the free-end following the shape of the at least one side surface of the tray is arranged at the distal end of the piston. A force-switching-state system, e.g. similar as disclosed in EP2695819 hereby incorporated by reference, is provided to maintain the piston in relation to the moving mechanism in an attracting force state such that the piston moves with the moving mechanism from an initial position to the labelling position. The physical contact with the at least one side of the tray creates an opposite repelling force onto the free end and thus the piston causing a separation of the displaceable piston from the moving mechanism. This separation causes a change of the force state of the displaceable piston from being in an attracting force state to a repelling force state, causing the linearly displaceable piston to move back to the resting position. It is thus ensured that the at least one side of the tray will in no way be damaged because a slight physical contact with the tray causes this change in force state.

In one embodiment, the conveyor means comprises a first conveyor and a second conveyor arranged end to an end with a space there between, and where the at least one applicator block is positioned within the space. In that way, a simple solution is provided for creating a space for the at least one applicator block arranged sidewise to the conveyor means.

In one embodiment, the length of the tray is longer that the length of the space, where the labelling apparatus further comprises a top-conveyor positioned above the space configured to interact with the top surface of the tray and advancing the tray in the conveying direction over the space where the labelling takes place. A support is thus provided from the top-conveyor both during the labelling takes place, and further it is prevented that the tray falls down into the space.

In a second aspect of the invention, a method is provided of labelling a tray while the tray is conveyed using a labelling device which comprises:

a label feeder device configured to place a label onto a top surface of the tray such that the label extends across the tray with a portion of the label exceeding at least one side surface of the tray, a first tucker device arranged sidewise to the conveyor means, comprising:

- at least one applicator block rotatable mounted to an axis extending parallel to the conveying direction and the at least one side surface of the tray,
- a first moving mechanism configured to move the at least one applicator block in a preferably horizontal back and forth direction perpendicular to the conveying direction of the tray, the method comprising the steps:

- moving, in response to a control signal, the at least one applicator block from an initial position to a labelling position where the at least one applicator block presses the portion of the label exceeding the at least one side surface of the tray towards the at least one side surface of the tray such that the at least one applicator block follows the shape of the at least one side surface of the tray via a rotational movement of the least one applicator block around the rotation axis. Accordingly, a simple solution is provided for labelling trays, that may contain any type of objects, such as, but not limited to, food objets where any type of space/cavity between the label and the tray is eliminated and thus the rish of destroying the label is eliminated.

In one embodiment, the at least one applicator block is designed such that the rotational movement of the least one applicator block around the rotation axis causes that one side of the at least one applicator block presses the label under the tray. It is thus ensured that the labelling can partly or fully encircle or wrap the label around a tray and form C or D-wrapped labelling.

In one embodiment, the labelling device further comprises a second tucker device arranged above the first tucker device, the second tack device comprising:

at least one structure having a free-end following the shape of the at least one side surface of the tray, the at least one structure being positioned adjacent and above the first tucker device, a second moving mechanism configured to move the structure in a preferably horizontal back and forth direction perpendicular to the conveying direction of the tray, wherein prior to said movement by the at least one applicator block, the method further comprises:

moving, in response to the control signal, the at least one structure to a labelling position where the free-end of the at least one structure presses the portion of the label exceeding at least one side surface of the tray towards an upper side portion of the at least one side surface of the tray.

Typically the label is an oblong label and where the step of placing the label onto the top surface of the tray comprises doing it so that the wide edge is leading. As already addressed, all kinds of labels with all kinds of shapes may be provided, preferably those having no backing paper, where instead e.g. glue lines are provided at appropriate positions on the label to ensure optimal labeling, e.g. a positions where said pressing at the upper side portion of the tray such that ad adhesion is provided between the glue line at the label and this upper position.

In general the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the drawings, in which.

DESCRIPTION OF EMBODIMENTS

Figure 1A:
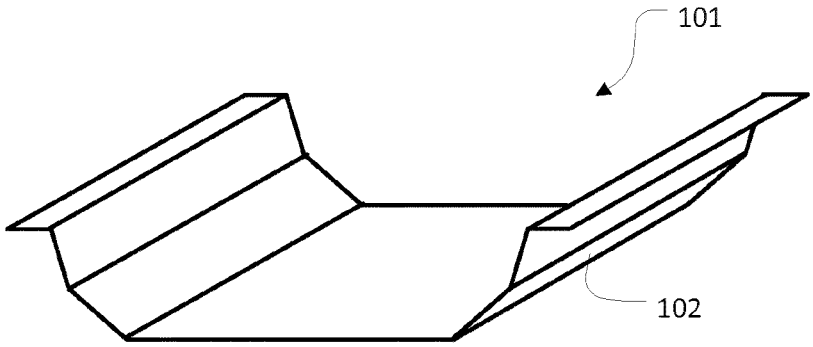
FIG. 1*a* depicts graphically a perspective view of an example of a tray used for storing food items.
Figure 1B:
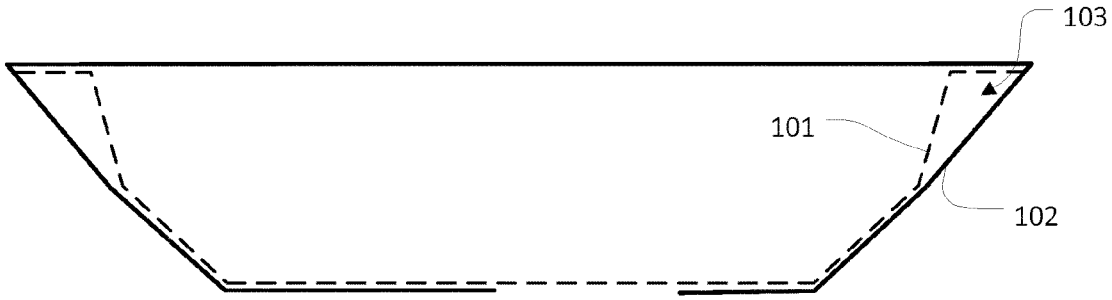
FIG. 1b (prior art)
FIG. 1*b* shows the tray in FIG. 1*a* after being labelled by a prior art labelling apparatus with an oblong label.
Figure 2:
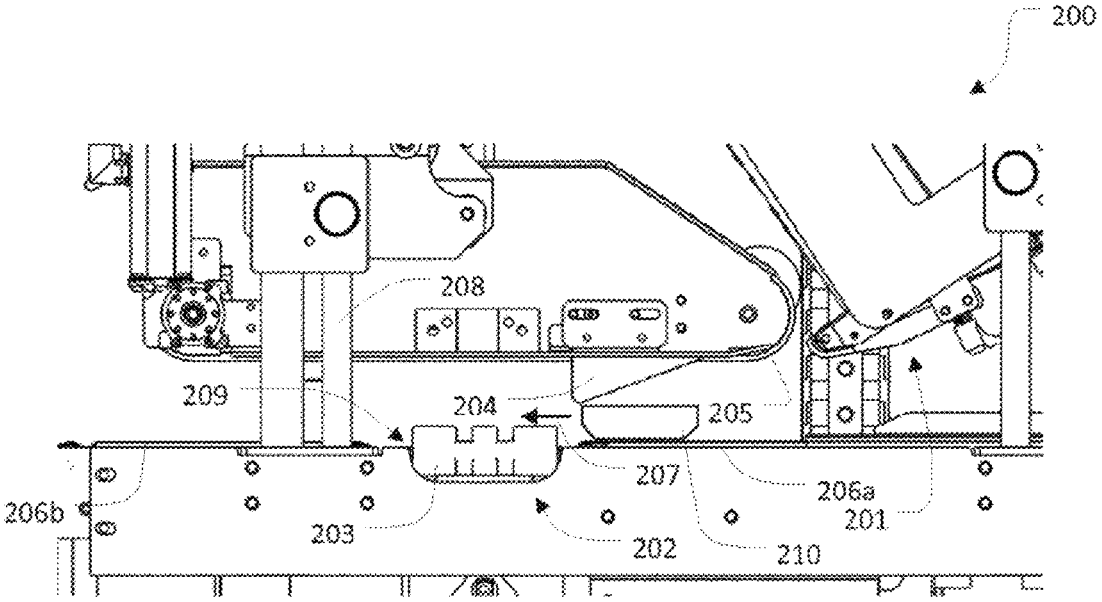
FIG. 2 depicts an embodiment of a labelling apparatus according to the present invention for labelling a tray.

FIG. 2 depicts an embodiment of a labelling apparatus 200 according to the present invention for labelling a tray 210, while the tray is conveyed by a conveyor means 206 in a conveying direction as indicated by arrow 207. The labelling apparatus comprises a label feeder device 201, a first tucker device 202 and a second tucker device which will be discussed in more details in relation to FIGS. 4*a*-4*c*.

The conveyor means 206 comprises a first conveyor 206*a* and a second conveyor 206*b* arranged end to an end with a space 209 there between, where the length of the tray 210 is significantly longer than the space length.

Figure 3:
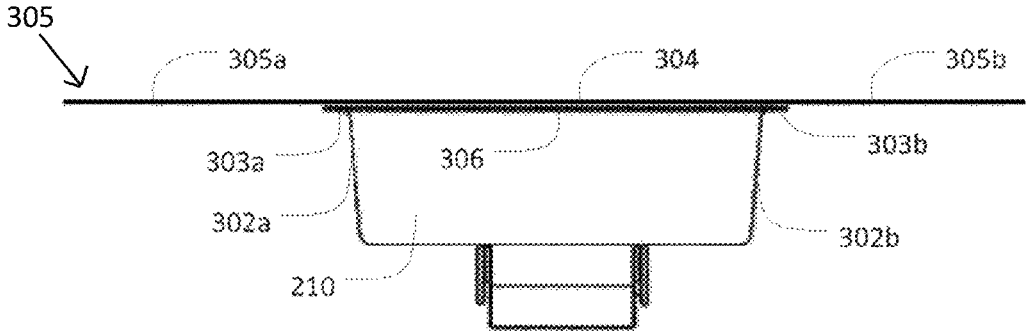
FIG. 3 shows a front view of a tray shown in FIG. 2 with a label and a portion of the label exceeding opposite side surfaces of the tray.

The label feeder device 201 is configured to place a label 304 as shown in FIG. 3 onto a top surface 306 of the tray 210, such that the label extends across the tray 210 with a portion of the label 305*a,b* exceeding both "lip" sides 302*a,b* and lips 303*a*, 303*b* of the tray as shown in FIG. 3 depicting a front/back view of the tray 210. It should be noted that this portion of the label might just as well just exceed one side of the tray.

The first tucker device 202 is arranged sidewise to the conveyor means 206 in the space 209 between the first conveyor 206*a* and the second conveyor 206*b*, where the first tucker device 202 comprises an applicator block 203 which is rotatable mounted to an axis extending parallel to the conveying direction 207 and the at least one side surface 302 of the tray 301.

The labelling apparatus 200 further comprises a top-conveyor 205 configured to interact with the top surface of the tray by means of advancing it in said conveying direction 207 at least while the labelling takes place, so as to prevent the tray from falling into the space 209 between the first and the second conveyor. The top-conveyor 205 may preferably be mechanically connected to a moving mechanism 208, which may be electrical, hydraulic etc. driven, for moving the top-conveyor 205 in an up or down position, but this must be done when different trays are to be labelled having different heights.

To facilitate the labelling process, as will be discussed in more details in relation to FIGS. 4*a*-4*c*, a folding plough 204 is provided arranged upstream in relation to the first tucker device 202 for interacting with the portion of the label 305 exceeding the surface sides 302*a,b* of the tray 210 so as to folding it down with the at least one side surface. In case the label 305 exceeds the both surface sides 302*a,b* as shown in FIG. 3 the labelling will result in a so-called D-wrap labelling, whereas if it exceeds only on side of the tray it will result in a so-called C-wrap labelling.

Figure 4A:
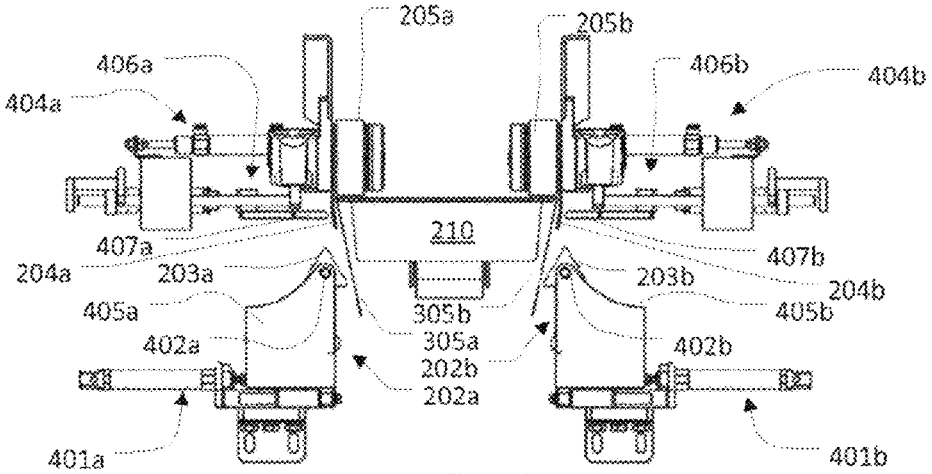
FIGS. 4*a*-4*c* depict a front view of the labelling apparatus shown in FIG. 2.
Figure 4B:
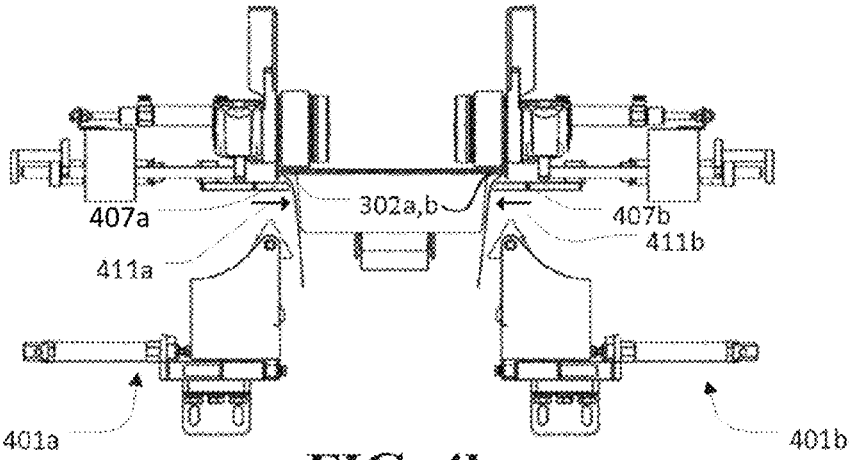
Figure 4C:
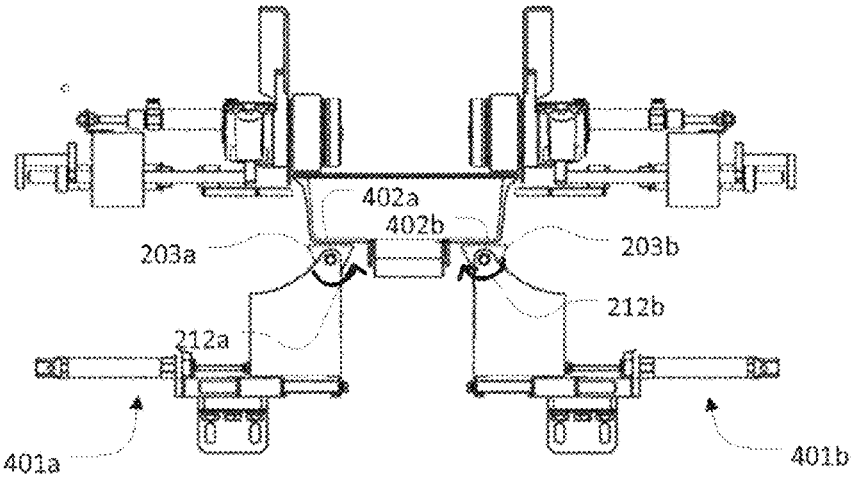

FIG. 4*a-c* depicts a front view of the labelling apparatus 200 shown in FIG. 2, showing in more details the applicator block 203*a,b* arranged opposingly to each other at opposite sides the conveyor means. A first moving mechanism 401 is shown configured to move the two applicator blocks 203 in a back and forth direction perpendicular to the conveying direction 207 of the tray 210. The first moving mechanism 401*a,b* may comprise an air-driven or electric driven jack, or similar means, that moves the applicator blocks 203*a,b* in a back and forth direction. The applicator blocks 203*a,b* are rotatable mounted to an axis 402*a,b* that is rigidly mounded to side structure pairs 405*a,b* and define a rotation axis being parallel to the conveying direction. As shown here, the applicator block 203*a,b* have a triangular cross-sectional shape for facilitating the labeling at the sides and below the tray. This will be discussed in more details below.

The front view shown here further shows said second tucker device 406*a,b* arranged above the first tucker device 202*a,b*, where the second tucker device comprises structure 407*a,b* at both sides of the conveyor means having a free-end following the shape of the at least one side surface of the tray, where the structures 407*a,b* are positioned adjacent and above the first tucker device 202*a,b*. The second tucker device 406*a,b* is connected to a second moving mechanism 404*a,b*, configured to move the structure in a back and forth direction perpendicular to the conveying direction of the tray. The second moving mechanism may in a preferred embodiment be similar to the one disclosed in EP2695819 hereby incorporated in its entirety by reference.

Also, the front view also shows where the top-conveyor 205, shown here as two conveyor sections 205*a,b*, interacts with the top surface of the tray 210 during the labeling prior to and/or during the labeling while simultaneously advancing it in said conveying direction.

It should be noted that before starting labelling a tray having specific geometric dimensions, and adjustment is needed for the first and the second tucker devices 203*a,b*, 406*a,b* so as to obtain optimal labelling. This may be done manually by an operator where via appropriate moving mechanism where height level of the tucker devices may be adjusted and/or the initial sidewise position, or automatically where one or more measuring devices may be provided for reading/measuring the height, width, length etc. and adjust the initial positions of the tucker devices accordingly.

Also, the width of the tray 210 may be used as input data in order to determine the labelling position, i.e. the travelling length of the tucker devices such that it is ensured that the tray will not be damaged during the labelling. This may especially be relevant for the first tucker device since the second moving mechanism may be based on the principle disclosed in EP2695819.

FIG. 4*a* shows the labelling apparatus 200 shortly before the labelling starts. As may be seen the tray 210 has passed the folding ploughs arranged at the opposite sides 204*a,b* causing that said portion of the label 305*a,b* exceeding the surface sides are partly folded down along the sides of the tray 210.

FIG. 4*b* depicts where the structures or plate structures 407*a,b* move as indicated by arrows 411*a,b*, in response to a control signal indicating the exact position of the tray, originating from e.g. any type of a sensor, from the starting position to a labelling position. In this case, the labeling position is below and adjacent the "lips" 302*a,b* of the tray. Referring to the above mentioned adjustment, it is accordingly important that the height level of the structures 407*a,b* is such that they press the label slightly below this lips 302*a,b*. It is important to note that in case the labels being used do not contain backing paper, but instead glue lines, that these glue lines are correctly positioned to ensure proper adhesion at this location below the lips. Accordingly, the step shown in FIG. 4*b* aims at obtaining an adhesion between the label and the tray at the corners of the lips 302*a,b*. Subsequent to pressing the label at the upper side of the tray below the lips, the structures 407*a,b* move automatically back to the original position.

FIG. 4*c* depicts where the labelling process in FIG. 4*b* is followed by the subsequent movement of the applicator blocks 203*a,b* where the applicator blocks presses the remaining portion of the label exceeding the at least one side surface of the tray towards the at least one side surface of the tray such that the at least one applicator block follows the shape of the at least one side surface of the tray via a rotational movement of the least one applicator block around the rotation axis. As shown here, the initial labeling process shown in FIG. 4*b* provides an adhesion between the label and the sides of the tray from the upper corner and downwards by the sides of the tray.

This subsequent movement completes the adhesion by pressing a lower portion of the tray sides followed by a rotational movement 212*a,b* of the triangular shaped applicator blocks 203*a,b* around the axis as shown in FIG. 4*c* such that one side of the triangle presses the a label portion to the bottom side of the tray and thus ensures a complete adhesion between the label and the tray and thus completes the labelling resulting in said D-wrap labelling.

The steps shown may also involve using said applicators etc. on only one side of the conveyor means, if the labelling is C-wrap labelling, i.e. where the side labelling process applies only on one side of the tray.

Figure 5:
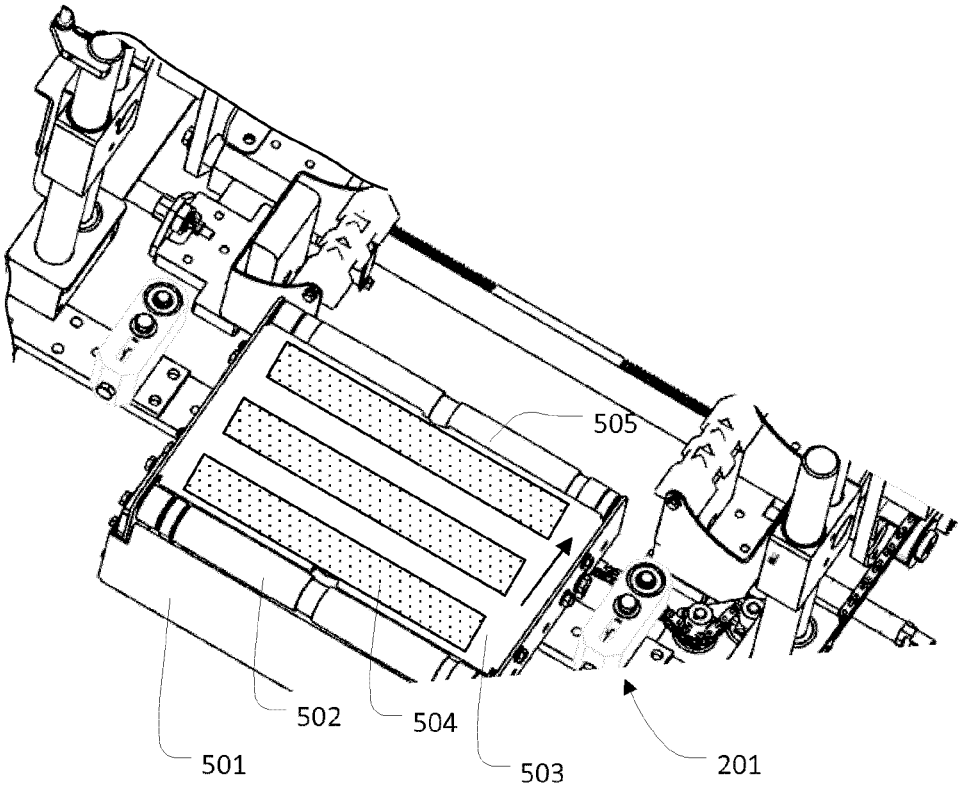
FIG. 5 depicts a more detailed view of the label feeder device shown in FIG. 2.

FIG. 5 depicts a more detailed view of a label feeder device 501 as shown as a label feeder device 201 in FIG. 2 comprising a label source which may e.g. comprise a label roller, a drive unit, and the like (not shown), where a continuous label feed is provided that undergoes a cutting unit 502 comprising a cutting blade that cuts the continuous label feed into portions that are separated and conveyed on an infeed conveyor 503 comprising an endless continuous belt in a direction as indicated by the arrow towards a free end roller 505 where the labels 504 are received by incoming trays (not shown), resulting in a tray with a label on where a portions of the label exceeds at least one side of the tray as shown in FIG. 3.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A labelling apparatus for labelling a tray while the tray is conveyed by a conveyor means, comprising:

a label feeder device configured to place a label onto a top surface of the tray such that the label extends across the tray with a portion of the label exceeding at least one side surface of the tray, a first tucker device arranged sidewise to the conveyor means, comprising:

at least one applicator block rotatably mounted to an axis extending parallel to a conveying direction and the at least one side surface of the tray, and a first moving mechanism configured to move the at least one applicator block in a back and forth direction perpendicular to the conveying direction of the tray, wherein during labelling the first moving mechanism, in response to a control signal, moves the at least one applicator block from an initial position to a labelling position where the at least one applicator block presses the portion of the label exceeding the at least one side surface of the tray towards the at least one side surface of the tray such that the at least one applicator block follows a shape of the at least one side surface of the tray via a rotational movement of the least one applicator block around a rotation axis; and a second tucker device arranged above the first tucker device, the second tucker device comprising:

at least one structure having a free-end following the shape of the at least one side surface of the tray, the at least one structure being positioned adjacent and above the first tucker device; and a second moving mechanism configured to move the structure in the back and forth direction perpendicular to the conveying direction of the tray;

wherein the at least one structure of the second tucker device is configured to extend proximate and below at least one protruding portion of the tray.

2. The labelling apparatus according to claim 1, wherein the axis is positioned such that the labelling apparatus presses towards a lower portion of the at least one side surface such that the at least one applicator block further follows a portion of the bottom of the tray.

3. The labelling apparatus according to claim 1, wherein the at least one applicator block comprises two opposingly arranged applicator blocks positioned at opposite sides of the conveyor means, and where the movement of the at least one applicator block in a back and forth direction comprises:

moving the two opposingly arranged applicator blocks towards each other where the applicator blocks simultaneously press the portion of the label exceeding both the side surfaces of the tray to the opposite surface sides of the tray, and moving the two applicator blocks away from the opposite side surface sides of the tray.

4. The labelling apparatus according to claim 1, further comprising at least one folding plough arranged upstream in relation to the first tucker device configured to interact with the portion of the label exceeding the at least one side surface of the tray so as to fold it down with the at least one side surface.

5. The labelling apparatus according to claim 1, wherein during labelling the second moving mechanism, in response to the control signal, is configured to initially move the at least one structure to the labelling position where the free-end of the at least one structure presses the portion of the label exceeding at least one side surface of the tray towards an upper side portion of the at least one side surface of the tray, followed by said labelling by the first moving mechanism where the remaining part of the portion of the label exceeding at least one side surface is pressed.

6. The labelling apparatus according to claim 1, wherein the at least one applicator block has a sloped face which in said initial position is parallel to the sides of the tray.

7. The labelling apparatus according to claim 1, wherein the at least one applicator block has a triangular cross sectional shape, the first tucker device further comprising an upwardly extending block having an upper flat surface, said initial position being an initial angular position where one side of the at least one triangular shaped applicator block is adjacent and parallel to the upper flat surface, the upper flat surface being configured to interact with the at least one triangular shaped applicator block subsequent to said labelling and bring the at least one applicator block back to said initial angular position.

8. The labelling apparatus according to claim 1, wherein the conveyor means comprises a first conveyor and a second conveyor arranged end to an end with a space there between, and where the at least one applicator block is positioned within the space.

9. The labelling apparatus according to claim 8, wherein the length of the tray is longer that the length of the space, where the labelling apparatus further comprises a top-conveyor positioned above the space configured to interact with the top surface of the tray and advancing the tray in the conveying direction over the space where the labelling takes place.

10. The labelling apparatus according to claim 1, wherein the control signal comprises information indicating a position of the tray.

11. The labelling apparatus according to claim 1, wherein the labelling apparatus is configured to apply the label proximate the at least one protruding portion of the tray such that substantially no space remains between the label and the tray proximate the at least one protruding portion.

12. A method of labelling a tray while the tray is conveyed using a labelling device which comprises:

a label feeder device configured to place a label onto a top surface of the tray such that the label extends across the tray with a portion of the label exceeding at least one side surface of the tray, a first tucker device arranged sidewise to a conveyor means, comprising:

at least one applicator block rotatably mounted to an axis extending parallel to the conveying direction and the at least one side surface of the tray, and a first moving mechanism configured to move the at least one applicator block in a back and forth direction perpendicular to the conveying direction of the tray, a second tucker device arranged above the first tucker device, the second tucker device comprising:

at least one structure having a free-end following the shape of the at least one side surface of the tray, the at least one structure being positioned adjacent and above the first tucker device, and a second moving mechanism configured to move the structure in the back and forth direction perpendicular to the conveying direction of the tray, the method comprising the steps:

moving, in response to a control signal, the at least one applicator block from an initial position to a labelling position where the at least one applicator block presses the portion of the label exceeding the at least one side surface of the tray towards the at least one side surface of the tray such that the at least one applicator block follows a shape of the at least one side surface of the tray via a rotational movement of the least one applicator block around a rotation axis;

wherein the at least one structure of the second tucker device is configured to extend proximate and below a protruding portion of the tray.

13. The method according to claim 12, wherein the at least one applicator block is designed such that the rotational movement of the least one applicator block around the rotation axis causes that one side of the at least one applicator block presses the label under the tray.

14. The method according to claim 12, wherein said label contains an adhesive region on the back side facing the top surface of the tray, and where prior to placing the label onto said top surface of the tray the label is advanced by an advancing means with a conveying speed being the same as a conveying speed of the tray, where subsequent to placing the label onto the top surface, the tray with the label pass at least one folding plough arranged upstream in relation to said first tucker device, where the at least one folding plough is configured to fold down the at least one side surface.

15. The method according to claim 12, wherein prior to said movement by the at least one applicator block, the method further comprises:

moving, in response to the control signal, the at least one structure to the labelling position where the free-end of the at least one structure presses the portion of the label exceeding at least one side surface of the tray towards an upper side portion of the at least one side surface of the tray.

* * * * *